US012473706B2

(12) United States Patent
Schauer

(10) Patent No.: US 12,473,706 B2
(45) Date of Patent: Nov. 18, 2025

(54) QUICK COUPLER

(71) Applicant: OilQuick Deutschland KG, Steindorf (DE)

(72) Inventor: Stefan Schauer, Kissing (DE)

(73) Assignee: OilQuick Deutschland KG, Steindorf (DE)

( * ) Notice: Subject to any disclaimer, the term of this patent is extended or adjusted under 35 U.S.C. 154(b) by 259 days.

(21) Appl. No.: 18/373,383

(22) Filed: Sep. 27, 2023

(65) Prior Publication Data

US 2024/0110359 A1 Apr. 4, 2024

(30) Foreign Application Priority Data

Sep. 29, 2022 (DE) ..... 10 2022 125 112.8

(51) Int. Cl.
*E02F 3/36* (2006.01)

(52) U.S. Cl.
CPC ..... *E02F 3/3622* (2013.01); *E02F 3/3618* (2013.01); *E02F 3/3663* (2013.01)

(58) Field of Classification Search
CPC ..... E02F 3/36; E02F 3/3604; E02F 3/3609; E02F 3/3618; E02F 3/3622; E02F 3/3627; E02F 3/3631; E02F 3/3636; E02F 3/364; E02F 3/365; E02F 3/3654; E02F 3/3663; E02F 3/3681; E02F 3/3686; E02F 3/369; E02F 3/3695

(Continued)

(56) References Cited

U.S. PATENT DOCUMENTS 5,802,753 A 9/1998 Raunisto
6,379,075 B1 * 4/2002 Shamblin ..... E02F 3/3663 37/468

(Continued)

FOREIGN PATENT DOCUMENTS

DE 10 2017 110 586 A1 11/2018
DE 102020121067 A1 2/2022

(Continued)

OTHER PUBLICATIONS

Result of Examination for German Patent Application No. 10 2022 125 112.8 filed Sep. 29, 2022.

*Primary Examiner* — Joshua E Rodden
(74) *Attorney, Agent, or Firm* — Fleit Intellectual Property Law; Paul D. Bianco

(57) ABSTRACT

A quick coupler for changing an attachment on a construction machine includes a carrier with a first receptacle arranged on one side of the carrier for receiving and holding a first coupling element and a second receptacle arranged on the other side of the carrier for receiving a second coupling element spaced from the first coupling element; a locking device associated with the second receptacle for lockably holding the second coupling element, with a driving element movable between a release and a locking position; and a fluid connection arranged between a connecting part and the movable driving element for supplying a working fluid. The fluid connection between the connecting part and the driving element is formed by at least one sliding element provided with a passage opening, with the sliding element arranged in a displaceable and sealed manner within a supply opening in the connecting part and/or the driving element.

10 Claims, 4 Drawing Sheets

(58) Field of Classification Search
USPC ..... 403/322.1
See application file for complete search history.

(56) References Cited

U.S. PATENT DOCUMENTS

| | | | | |
|---|---|---|---|---|
| 7,654,787 | B2 * | 2/2010 | Sonerud | B66C 3/005 414/723 |
| 7,735,249 | B2 * | 6/2010 | Muller | E02F 3/3663 37/468 |
| 7,963,716 | B2 | 6/2011 | Yamasaki | |
| 12,110,649 | B2 * | 10/2024 | Hughes | E02F 3/3622 |
| 2011/0147032 | A1 * | 6/2011 | Weyer | E02F 3/3663 173/218 |
| 2014/0321956 | A1 * | 10/2014 | Frey | E02F 3/364 414/723 |
| 2020/0002913 | A1 * | 1/2020 | Kollmann | E02F 9/26 |
| 2020/0190765 | A1 * | 6/2020 | Clemons | E02F 3/3622 |
| 2020/0283989 | A1 * | 9/2020 | Schmid | E02F 3/3686 |
| 2023/0151581 | A1 * | 5/2023 | Rogers | E02F 3/365 37/468 |
| 2024/0376683 | A1 * | 11/2024 | Hughes | E02F 3/3622 |

FOREIGN PATENT DOCUMENTS

| | | | | |
|---|---|---|---|---|
| EP | 0976962 | A2 | 2/2000 | |
| EP | 3312350 | A1 | 4/2018 | |
| GB | 2545731 | A | 6/2017 | |
| WO | 2004/072387 | A1 | 8/2004 | |
| WO | 2007/088674 | A1 | 8/2007 | |
| WO | 2007/114601 | A2 | 10/2007 | |
| WO | WO-2010062166 | A1 * | 6/2010 | E02F 3/3663 |
| WO | 2022/028974 | A1 | 2/2022 | |

* cited by examiner

QUICK COUPLER

FIELD OF THE INVENTION

The invention relates to a quick coupler.

BACKGROUND

Such quick couplers are used for easy and convenient changing of different attachments on construction machines. With such a quick coupler, e.g. swing buckets, grabs, shears, compactors, magnets, hydraulic hammers or other attachments can be coupled or uncoupled in a few seconds and with a high safety standard from an operator's cab, e.g. on a boom of an excavator.

A generic quick coupler is known from DE 10 2017 110 586 A1. This contains a carrier which can be attached to a boom of an excavator and which has, on one side, first receptacles with a locking device movable between a release position and a locking position for holding a first coupling element provided on an attachment and, on the other side, second receptacles for holding a second coupling element spaced from the first coupling element. In quick couplers of this type, the hydraulic fluid or other corresponding working medium required to supply the attachments is usually transported via supply hoses from a stationary distributor to the connections of the respective consumers. However, as the trend is towards increasing oil quantities and decreasing back pressures, correspondingly bigger cross-sections are required. However, especially with smaller quick couplers, there is only limited space available for the corresponding supply lines and the minimum bending radii must also be observed. Therefore, smaller nominal diameters must be used and the connecting hoses must also be designed to be correspondingly flexible. However, this involves considerable effort and the delivery rate is also limited.

SUMMARY

One aspect of the invention is to create a compactly constructed quick coupler of the type discussed above, which enables an optimal supply of a working fluid even with smaller dimensioned carriers.

Practical embodiments and advantageous further developments of the invention are disclosed herein.

In the quick coupler according to the invention, the fluid connection between a connecting part fixedly arranged on the carrier and a driving element movable relative to the carrier is formed by at least one sliding element provided with a passage opening, the sliding element being arranged displaceably and radially sealed within a supply opening in the connecting part and/or the driving element. Due to the rigid sliding elements formed as hollow bodies in the manner of a sliding bush, a fluid connection between a connecting part fixedly arranged on the carrier and a driving element movable relative to the carrier can be achieved without hoses. A fluid connection formed via sliding elements is particularly low-maintenance and insensitive to damage. The fluid connection also requires only a small installation space and thus enables a particularly compact design.

In an expedient embodiment, the sliding element provided with a passage opening can be arranged with its one end fixed within a supply opening in the driving element and with its other end displaceable within a supply opening of the connecting part. However, the sliding element can also be arranged firmly on the connecting part and displaceably as well as radially and/or axially or sealed on the front side within a supply opening of the driving element. A displaceable arrangement of the sliding element both within the driving element and within the connecting part is also possible.

In a constructively simple and advantageous design in terms of production technology, the sliding element can be designed as a connecting tube and the supply opening as a bore with an inner diameter adapted to the outer diameter of the connecting tube. However, the sliding element and the associated conveying opening can also have a different structural design. The sliding element can, for example, also be designed as a telescopic rod or as a differently designed sliding part.

The sliding element can be expediently sealed off from the supply opening in the driving element and/or the connecting part by means of a radial seal.

The connecting part can be designed as a pressure fluid distributor for connection to a rotary union of a rotary drive. However, the connecting part can also have a different design, especially in the case of a non-rotatable arrangement of the quick coupler.

In a particularly practical embodiment, the fluid supply comprises two sliding elements for supplying the driving element for its displacement between a release and locking position. This allows the supply to the drive of the locking device without hose connections. The quick coupler may further comprise sliding elements for supplying quick couplings arranged on the driving element. This allows a working fluid to be supplied to the quick coupler, even without hose connections, not only to actuate the locking mechanism, but also to supply or actuate working attachments. The fluid connection between the parts that are fixed to the carrier and the parts that are movable relative to the carrier can thus be made completely without hoses.

BRIEF DESCRIPTION OF THE DRAWINGS

Further features and advantages of the invention will be apparent from the following description of a preferred example of an embodiment based on the drawing. It shows in.

DETAILED DESCRIPTION

FIGS. 1 to 8 show a quick coupler that can be attached to an excavator, for example, for easy and convenient changing of different attachments in various positions and views. With such a quick coupler, e.g. swing buckets, grabs, shears, magnets, compactors, hydraulic hammers or other mechanical or hydraulic attachments can be easily and conveniently coupled or uncoupled to or from a boom or other attachment of an excavator or other construction vehicle from an operator's cab.

Figure 1:
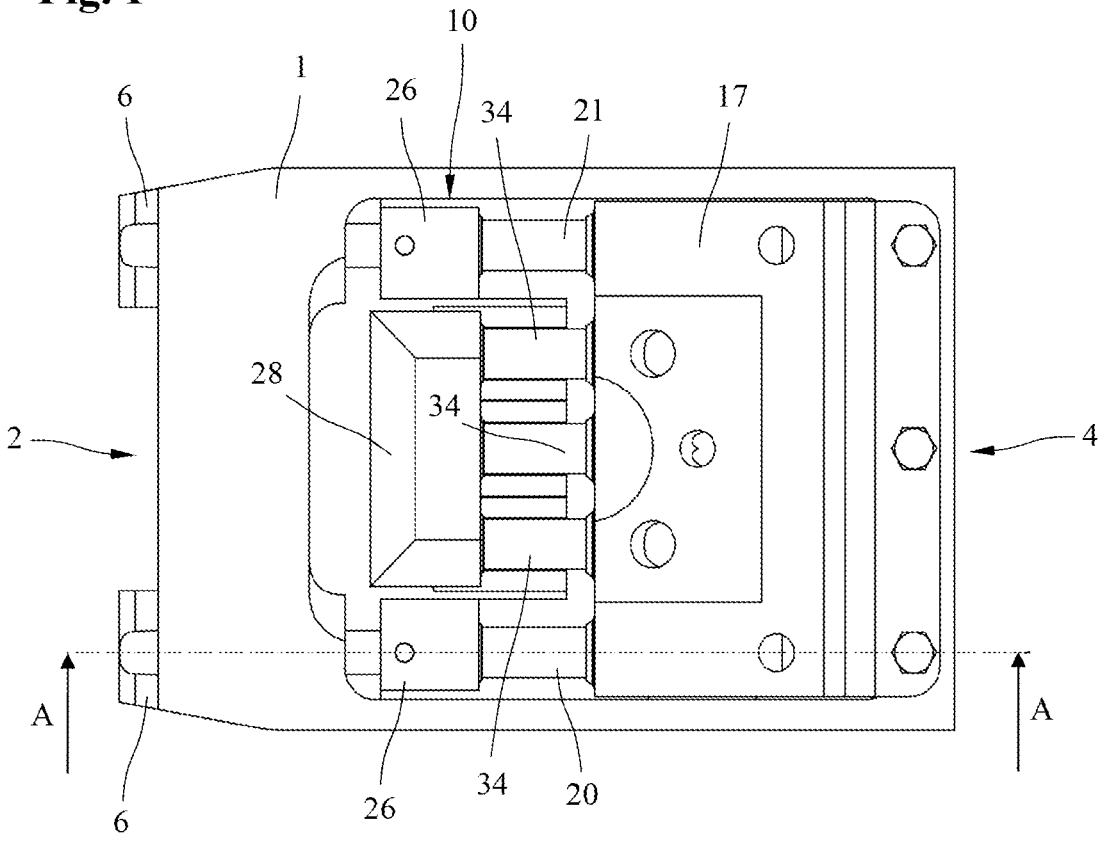
FIG. 1 a top view of a quick coupler for changing different attachments in an unlocked position.
Figure 2:
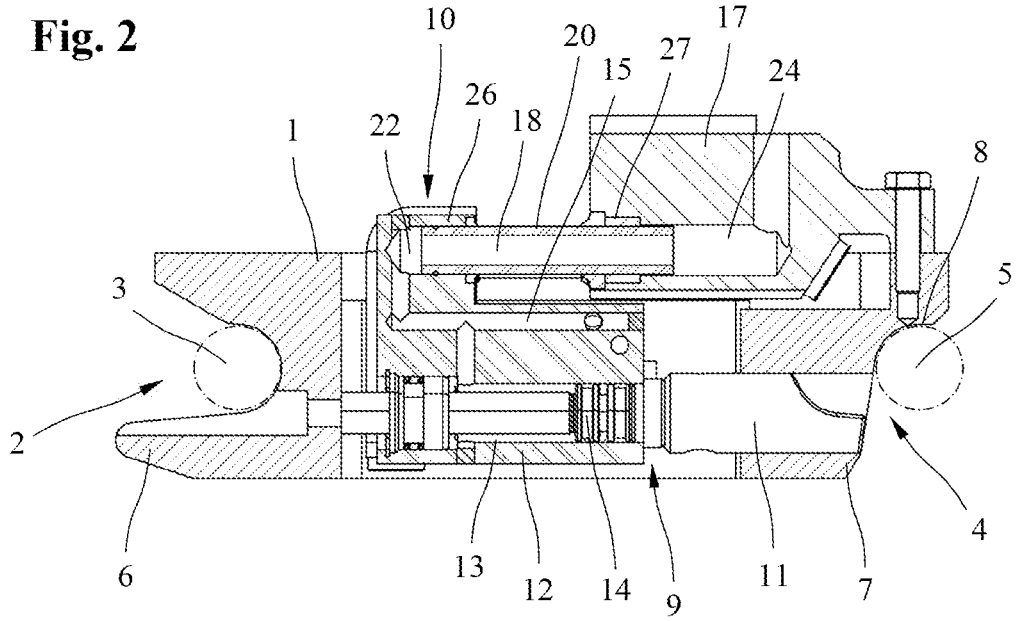
FIG. 2 a sectional view of the quick coupler along line A-A of FIG. 1.
Figure 3:
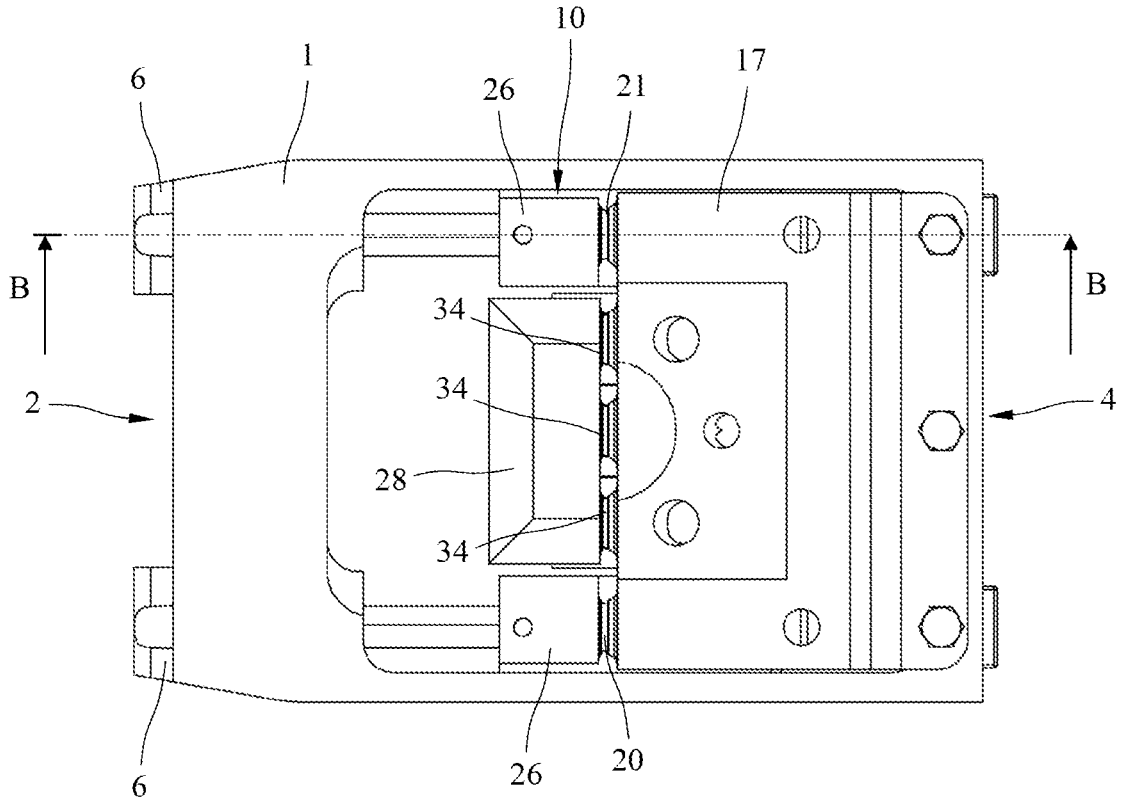
FIG. 3 a top view of a quick coupler for changing different attachments in a locked position.

As can be seen from the sectional view of FIG. 2, the quick coupler contains a frame-shaped carrier 1 made as a welded construction or a cast part, which has on one side a first receptacle 2 for receiving and holding a first bolt-shaped coupling element 3, which is only indicated by a dashed line, and on the other side a second receptacle 4 for receiving and holding a second bolt-shaped coupling element 5, which is spaced apart from the first bolt-shaped coupling element 3. The two mutually parallel bolt-shaped coupling elements 3 and 5 can be arranged directly on an attachment or on an adapter that can be attached to the attachment.

In the embodiment shown, the first receptacle 2 arranged on one side of the carrier 1 comprises two spaced-apart, claw-shaped first receiving regions 6 open towards the front, while the second receptacle 4 arranged on the other side of the carrier 1 comprises two spaced-apart, downwardly open second receiving regions 7 with an upper contact surface 8.

A locking device 9, which can be seen in FIG. 2, is provided on the two receiving parts 7 of the second receptacle 4 for lockably holding the first coupling element 5 on the carrier 1. The locking device 9 contains a driving element 10 which is displaceable in the direction of the longitudinal axis of the carrier 1 or parallel thereto between a release position and a locking position, and on which two locking elements 11, designed as locking bolts and displaceably guided within the carrier 1, are arranged between a retracted release or change position shown in FIG. 2 and an extended locking position shown in FIG. 4 for holding the first coupling element on the carrier 1. In the extended locking position shown in FIG. 4, the downwardly open receiving regions 7 of the second receptacle 4 are closed on the underside by the locking elements 11 which are displaceably arranged in guide bores in the carrier 7, so that the second bolt-shaped coupling element 5 is engaged underneath by the bolt-shaped locking elements 11.

In the embodiment shown, the driving element 10 is designed as a hydraulically displaceable, H-shaped cylinder, on each of whose two parallel outer parts 12 a bolt-shaped locking element 11 is arranged for the locking retention of the second coupling element 5 on the second receiving regions 7. As can be seen from FIGS. 2 and 4, the driving element 10, which is in the form of an H-cylinder, is displaceable by means of a respective piston 14 arranged within a cylindrical pressure chamber 13 inside the two outer parts 12 of the cylindrical driving element 10, together with the two bolt-shaped locking elements 11, by applying appropriate pressure between the release or change position shown in FIG. 1 and the locking position shown in FIG. 4. In the release or change position of FIG. 2, the bolt-shaped locking elements 11 are retracted and an implement can be uncoupled or coupled. In the locking position shown in FIG. 4, the bolt-shaped locking elements 11 are extended and engage under the second bolt-shaped coupling element 5 for the locked retention of an attachment.

Figure 4:
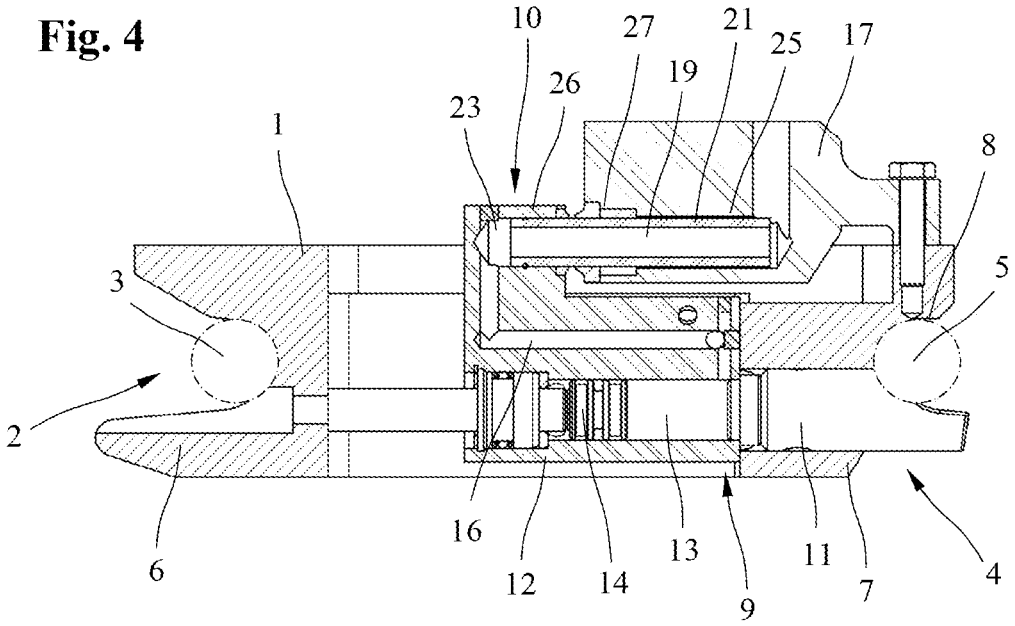
FIG. 4 a sectional view of the quick coupler along line B-B of FIG. 3.

FIGS. 2 and 4 also show that supply channels 15 and 16 for supplying a pressurised fluid to displace the driving element 10 are formed in the driving element 10, which is in the form of an H-cylinder, by a plurality of supply bores and lead to the pressure chamber 13. By pressurising the first supply channel 15 shown in FIG. 2, the bolt-shaped locking elements 11 can be extended, while the bolt-shaped locking elements 11 can be retracted by pressurising the second supply channel 16 shown in FIG. 4.

For the fluid connection between a stationary connecting part 17 arranged on the carrier 1 and designed as a pressure fluid distributor and the displaceable driving element 10, two rigid first and second sliding elements 20 and 21 are provided for the displacement of the driving element, each sliding element 20 and 21 provided with a passage opening 18 or 19 and designed here as connecting tubes, which in the embodiment example shown have one end arranged within a first and second feed opening 22 or 23 respectively, in the displaceable driving element 10, designed as an H-cylinder, the first and second feed openings being in connection with the supply channels 15 or 16 in the displaceable driving element 10—and have their other end arranged displaceably and radially sealed within a third and fourth supply opening 24 and 25 in the connecting part 17. For this, the driving element 10 designed as an H-cylinder has upwardly projecting projections 26 for the supply openings 22 and 23 designed as blind holes for receiving the tubular sliding elements 20 and 21. The supply openings 24 and 25 in the connecting part 17 are also designed as blind holes for receiving the tubular sliding elements 20 and 21. The tubular sliding elements 20 and 21 are sealed from the fixed connecting part 17 by means of gaskets 27.

If the bore 24 shown in FIG. 2 is pressurised with a working fluid, the working fluid can reach one side of the pressure chamber 13 via the passage opening 18 of the first tubular sliding element 20, the supply opening 22 and the feed channel 15, so that the driving element 10 comprising the bolt-shaped locking elements 11 can be moved to the retracted unlocking and changing position. If, on the other hand, the feed opening 25 shown in FIG. 4 is pressurised with a working fluid, the working fluid can reach the other side of the pressure chamber 13 via the passage opening 19 of the second tubular sliding element 21, the feed opening 23 and the feed channel 16, so that the driving element 10 can be moved together with the bolt-shaped locking elements 11 into the extended locking position.

The tubular sliding elements 20 and 21 do not necessarily have to be fixed to the driving element 10, but can also be fixed to the connecting part 17 in a corresponding manner and arranged axially displaceably as well as radially sealed within conveying openings or bores of the driving element 10. A displaceable arrangement of the tubular sliding elements 20 and 21 both within the driving element 10 and within the connecting part 17 is also possible. The connecting part 17, which is designed as a pressure fluid distributor, can be designed as a separate component and arranged fixedly on the carrier 1, for example by means of screws. However, the connecting part 17 can also be designed as an integral part of the carrier 1. Via the connecting part 17, the quick coupler can be attached, for example, to the rotary union of a rotary drive or to another attachment part.

Figure 5:
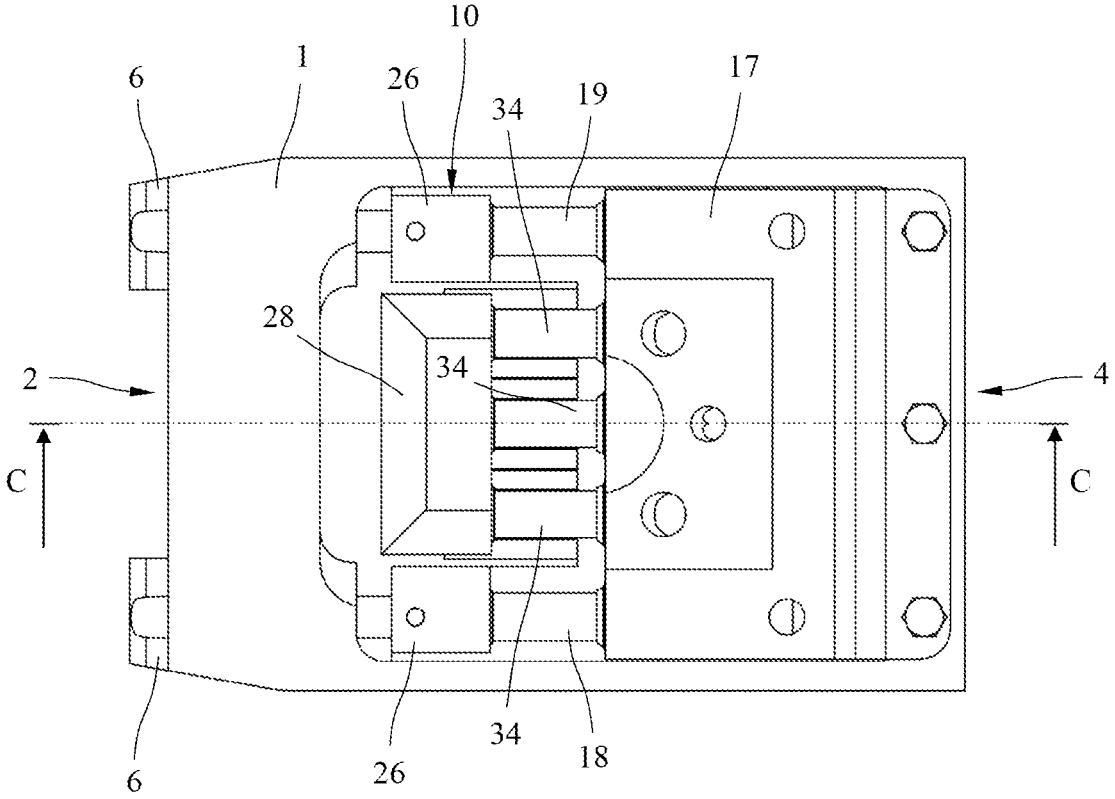
FIG. 5 a top view of a quick coupler for changing different attachments in an unlocked position.
Figure 6:
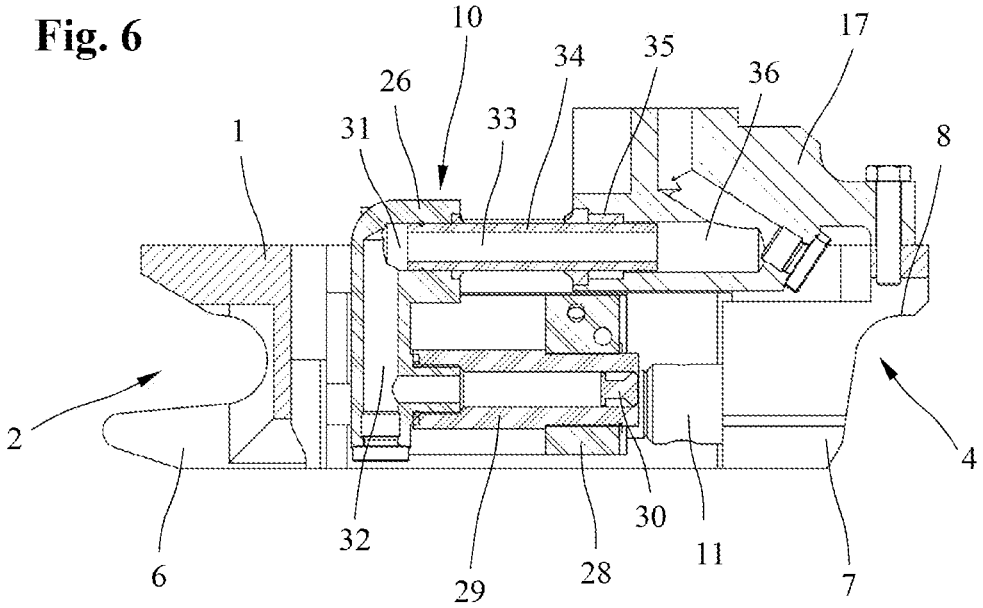
FIG. 6 a sectional view of the quick coupler along line C-C of FIG. 5.
Figure 7:
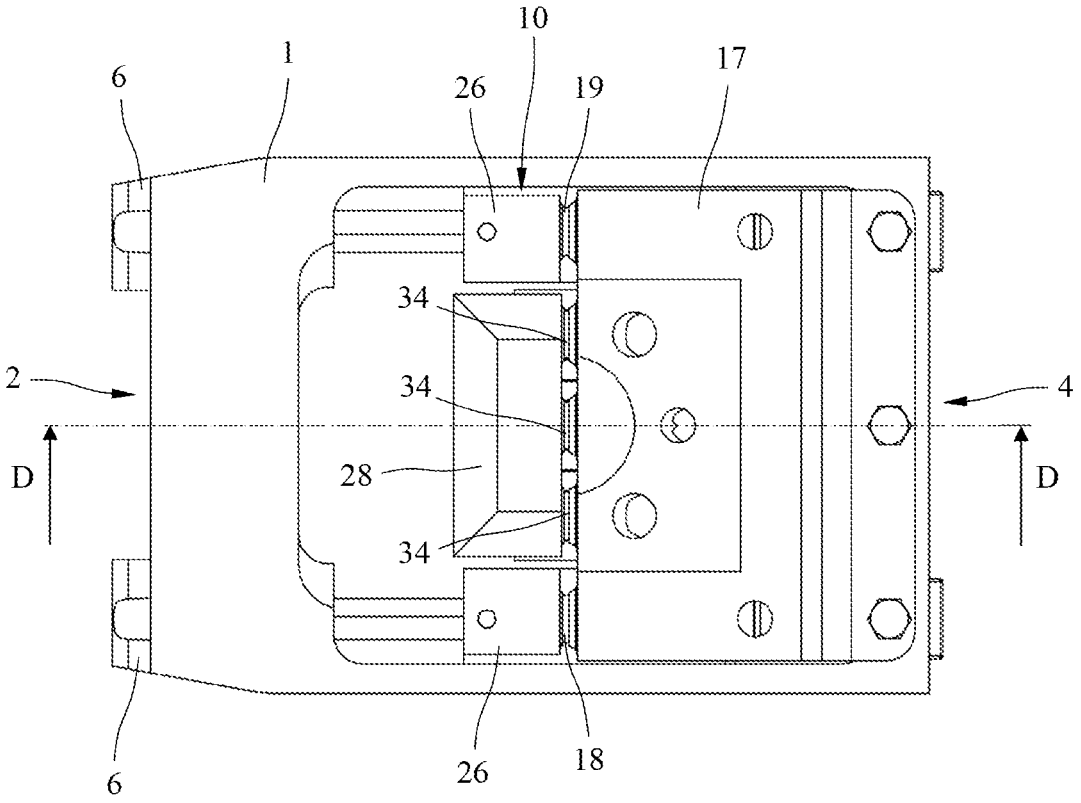
FIG. 7 a top view of a quick coupler for changing different attachments in a locked position.
Figure 8:
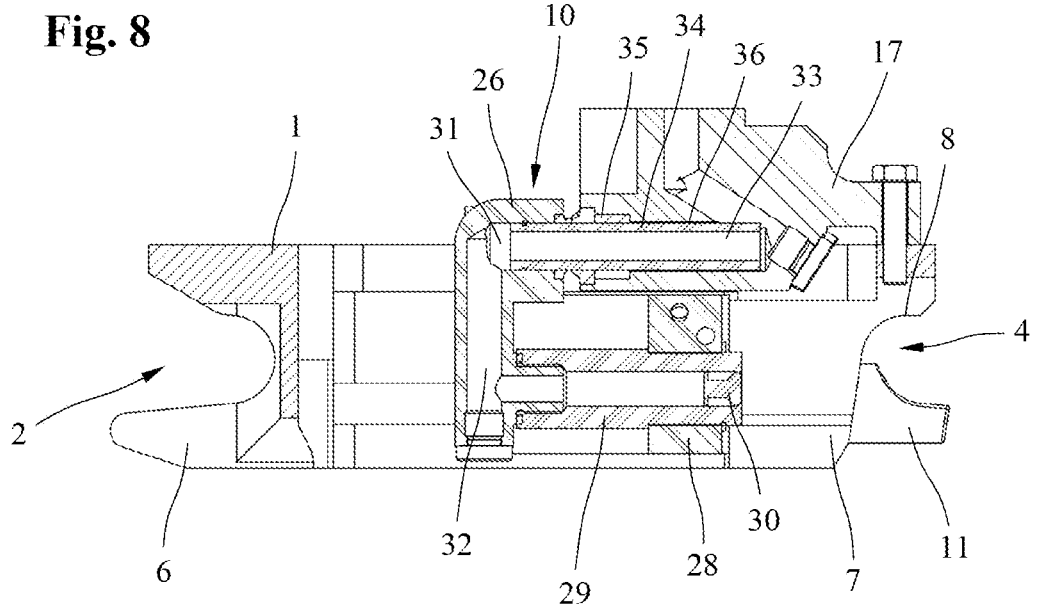
FIG. 8 a sectional view of the quick coupler along line D-D of FIG. 7.

As can be seen from FIGS. 5 and 6, a number of hydraulic quick couplings 29 are arranged next to each other between the two locking elements 11 on a middle part 28 of the driving element 10, which is designed as an H-cylinder and can be moved in the longitudinal direction of the carrier 1. The hydraulic quick couplings 29 are arranged and designed in such a way that, when the driving element 10 is moved into the locking position, they are coupled to corresponding counterparts on an adapter or attachment in order to supply the attachment with a working medium. There are end caps 30 on the quick couplings 29, which open automatically when the quick couplings 29 couple with the counterpart. In order to be able to supply the quick couplings 29 with a working medium, a supply channel 32 leading from a supply opening 31 in the upper projection 26 of the driving element 10 to the quick coupling 29 is arranged in the driving element 10, which is designed as an H-cylinder.

In order to establish a fluid connection between the connecting part 17 arranged on the carrier 1 and the quick couplings 29, tubular slide elements 34 provided with a passage opening 33 are also provided here, which in the embodiment example shown are arranged with their one end fixed within the supply opening 31 in the upper projection 26 of the driving element 10 and with their other end displaceable and radially and/or axially sealed within a supply opening 36 in the connecting part 17 via a gasket 35. In a corresponding manner, the tubular sliding elements 34 can also be fixedly attached to the connecting part 17 and arranged in an axially displaceable and radially and/or axially sealed manner within the bore 31 in the driving element 10. Here, too, a displaceable arrangement of the sliding elements 34 within the driving element and within the connecting part 17 is possible.

In order to couple an attachment with the aid of the quick coupler described above, the quick coupler, which is usually attached to an excavator boom and to the coupler, is first moved in such a way that a first bolt-shaped coupling element 3 arranged on the adapter or directly on the attachment is inserted into the claw- or fork-shaped first receiving regions 6 of the first receptacle 2. Then, with the locking elements 11 still retracted, the quick coupler 1 is pivoted around the first bolt-shaped coupling element 3 in such a way that the second coupling element on the adapter or attachment comes into contact with the contact surfaces 8 of the downwardly open second receiving regions 7 of the second receptacle 4. Subsequently, the locking elements 11, which are displaceably arranged in guide bores in the carrier 1 of the quickcoupler, can be hydraulically extended via the driving element 10, which is designed as an H-cylinder and extends in the longitudinal direction of the quickcoupler, so that the second bolt-shaped coupling element 5 is engaged underneath by the two bolt-shaped locking elements 11 on the quickcoupler 1 and the attachment is thus held on the quickcoupler.

When the driving element 10 is moved into the locking position, the quick couplings 29 arranged on the middle part 28 of the driving element 10 between the two locking elements 11 are also moved and can be coupled with the corresponding counterparts on an adapter or attachment so that the attachments can be supplied with a working fluid via the quick couplings.

It can be seen that the fluid connection between the parts fixed to the carrier and the parts movable relative to the carrier can be made completely without hoses. This allows a working fluid to be supplied to the quick coupler, even without hose connections, not only to operate the locking mechanism, but also to supply or operate attachments.

LIST OF REFERENCE SIGNS

1 Carrier
2 first receptacle
3 first coupling element
4 second receptacle
5 second coupling element
6 first receiving region
7 second receiving region
8 Upper contact surface
9 locking device
10 driving element
11 locking element
12 Outer part
13 pressure chamber
14 piston
15 first supply channel
16 second supply channel
17 connecting part
18 First passage opening
19 Second passage opening
20 first sliding element
21 second sliding element
22 First supply opening
23 Second supply opening
24 Third supply opening
25 Fourth supply opening
26 projection
27 gasket
28 middle part
29 quick coupling
30 end cap
31 supply opening
32 supply channel
33 Passage opening
34 Further tubular connecting piece
35 gasket
36 Conveyor opening

The invention claimed is:

1. A quick coupler for changing an attachment on a construction machine, the quick coupler comprising:

a carrier with a first receptacle arranged on one side of the carrier for receiving and holding a first coupling element and a second receptacle arranged on another side of the carrier for receiving a second coupling element spaced from the first coupling element, a locking device associated with the second receptacle for lockably holding the second coupling element and having a driving element movable between a release position and a locking position, and a fluid connection arranged between a connecting part and the movable driving element for supplying a working fluid, wherein the fluid connection between the connecting part and the driving element is formed by at least one sliding element provided with a passage opening, whereby the sliding element is arranged displaceably and sealed within a supply opening in at least one of the connecting part and the driving element.

2. The quick coupler according to claim 1, wherein the at least one sliding element is arranged with one end fixed within the supply opening in the driving element and with another end displaceable and radially sealed within the supply opening of the connecting part.

3. The quick coupler according to claim 1, wherein the at least one sliding element is formed as a connecting tube and the supply opening in at least one of the connecting part and the driving element is formed as a bore with an inner diameter adapted to an outer diameter of the connecting tube.

4. The quick coupler according to claim 1, wherein the at least one sliding element is sealed via a gasket with respect to the supply opening in at least one of the connecting part and the driving element.

5. The quick coupler according to claim 1, wherein the connecting part is designed as a pressure fluid distributor for connection to a rotary union of a rotary drive.

6. The quick coupler according to claim 1, wherein the fluid connection comprises two sliding elements for supplying the driving element for displacement between the release position and the locking position.

7. The quick coupler according to claim 1, wherein the at least one sliding element comprises sliding elements for supplying quick couplings arranged on the driving element.

8. The quick coupler according to claim 1, wherein the driving element is designed as an H-shaped cylinder which is hydraulically displaceable in a direction of a longitudinal axis of the carrier or parallel thereto.

9. The quick coupler according to claim 1, wherein the locking device comprises bolt-shaped locking elements arranged on the driving element.

10. The quick coupler according to claim 1, wherein the first receptacle comprises two spaced-apart claw-shaped first receiving regions open towards a front and wherein the second receptacle comprises two spaced-apart second receiving regions open towards a bottom and having an upper contact surface.

* * * * *